United States Patent [19]

Schmitt

[11] Patent Number: 4,583,705

[45] Date of Patent: Apr. 22, 1986

[54] FLOOR STAND

[75] Inventor: Paul Schmitt, Lauterbach, Fed. Rep. of Germany

[73] Assignee: Gustav Stabernack GmbH, Fed. Rep. of Germany

[21] Appl. No.: 664,259

[22] Filed: Oct. 24, 1984

[30] Foreign Application Priority Data

Oct. 27, 1983 [DE] Fed. Rep. of Germany ..... 8330781

[51] Int. Cl.[4] ..... A47F 1/00

[52] U.S. Cl. ..... 248/174; 206/44 R; 211/132

[58] Field of Search ..... 248/174, 459; 211/72, 211/73, 132; 206/44 R

[56] References Cited

U.S. PATENT DOCUMENTS

| | | | |
|---|---|---|---|
| 2,066,844 | 1/1937 | Lynch | 211/133 X |
| 2,190,127 | 2/1940 | Stocker | 248/174 |
| 2,745,617 | 5/1956 | Paige | 211/133 X |
| 2,940,710 | 6/1960 | Adams | 248/174 |
| 3,164,350 | 1/1965 | Taub | 248/174 |
| 3,340,998 | 9/1967 | Wilson | 248/174 |
| 3,836,104 | 9/1974 | Miller et al. | 248/174 X |

FOREIGN PATENT DOCUMENTS 2902573 1/1979 Fed. Rep. of Germany .

*Primary Examiner*—Robert W. Gibson, Jr.
*Assistant Examiner*—Sarah A. L. Eley
*Attorney, Agent, or Firm*—Robert D. Yeager; Christine R. Ethridge

[57] ABSTRACT

Floor stand with a tubular leg (1) of folding material, to which is attached a device (2) for the housing and presentation of merchandise, which is constructed as a deep-drawn plastics component in the manner of a tray, with a base surface and with encircling end faces (15) integrally moulded to its edges and pointing downwards and also directly mutually connected, whilst a correspondingly profiled connecting plate (16) of corrugated board material, which is inserted into the housing space formed by the base surface and the encircling end faces of the housing device, is glued by its underside to a roof panel part of the leg and by its upper side to the base surface of the housing device.

8 Claims, 3 Drawing Figures

FLOOR STAND

BACKGROUND OF THE INVENTION

1. Field of the Invention

The invention relates to a floor stand having a tubular leg of folding material and having a device for the housing and presentation of merchandize.

2. Description of the Prior Art

Floor stands of this type are also known as so-called instant displays and have proved satisfactory in practice. A basic embodiment of such a floor stand is described in the Applicant's German Offenlegungsschrift No. 2,902,573, in FIGS. 8 and 9. They possess the advantage which is guite essential for practical purposes, that the leg can in a sense be wound in U-shape or L-shape round the folded cuboid container with economy of space, so that the container filled with the relevant articles can be shipped together with its leg with economy of space. At the point of sale, in a store for example, the floor stand is then unfolded with effortless ease, for which purpose the leg needs only to be brought into its extended position, whereupon it is pivoted beneath the container. During this pivoting process the leg is automatically unfolded, namely because the distance between its front wall and rear wall is enlarged to the distance of the service position during the above-mentioned pivoting process.

Whereas in the above-mentioned Offenlegungsschrift the connection between the leg and the container was made via two separate glued staps. European Published Application No. 54,889 describes a similar floor stand, in which the connection between the leg and the container is made via a roof panel which, in a sense, bridges the front wall and rear wall of the leg. The present invention can be used for all types of such floor stands according to these publications.

It is common to these known, and also to other similar floor stands, that the housing device is a container made of folding material. As examples, the floor stand according to U.S. Pat. No. 3,164,350 may also be mentioned. However the construction provided by the latter for the housing device glued onto the leg as a container of folding material restricts its field of use, because, for example, tubes and other elongate merchandise cannot be presented standing upright in the containers to the customer.

It is therefore the object of the invention to propose a floor stand of the type initially mentioned which, whilst retaining the advantages of this floor stand is characterised in that merchandize of virtually any desired shape can be retained securely positioned in the housing device.

SUMMARY OF THE INVENTION

This object of the invention is achieved when the housing device is constructed as a deep-drawn plastics component in the manner of a tray with a base surface and with encircling end faces integrally moulded to its edges, pointing downwards and also directly mutually connected, whilst a correspondingly profiled connecting plate of corrugated board material, which is inserted into the housing space formed by the base surface and the encircling end faces of the housing device, is glued by its underside to the roof panel part of the leg and by its upper side to the base surface of the housing device.

The housing device therefore consists of deep-drawn plastic material, which can be shaped to correspond to the requirements in each case. The necessary connection between the deep-drawn plastic part and the relevant roof panel part of the leg is provided by the connecting plate, which can readily consist of corrugated board material because this material is cheap. The plastic material is stiffened by the encircling rim, which is constructed in the manner of an apron. By this means, the said housing space for the connecting plate of corrugated board material is created simultaneously, so that the entire structure has high torsional resistance and can withstand all stresses arising in service.

The base surface of the plastic part is shaped to correspond to the requirements in each case. As a general rule, it contains side by side a plurality of housings for retaining the corresponding merchandise which is to be housed and presented therein. In order to make a sufficient gluing surface available in spite of these depressions, it is preferred that, in this embodiment, the bases of the depressions provided therefor in the base of the plastic part are of flat construction, so that they can be glued to the upper side of the connecting plate.

For reasons of easy handling and also of design, it is preferred that the thickness of the connecting plate is approximately equal to the height of the housing space, measured between the upper edges of the end faces and the gluing surface of the plastic part. In this case the connecting plate of corrugated board material is not visible from outside, whilst nevertheless the total available depth is utilised for the corrugated board layer, which substantially reinforces the plastic part moulded in the manner of a tray.

BRIEF DESCRIPTION OF THE DRAWINGS

The invention is explained more fully below with reference to an embodiment example from which further important features emerge. In the drawing.

DETAILED DESCRIPTION OF THE PREFERRED EMBODIMENT

Figure 1:
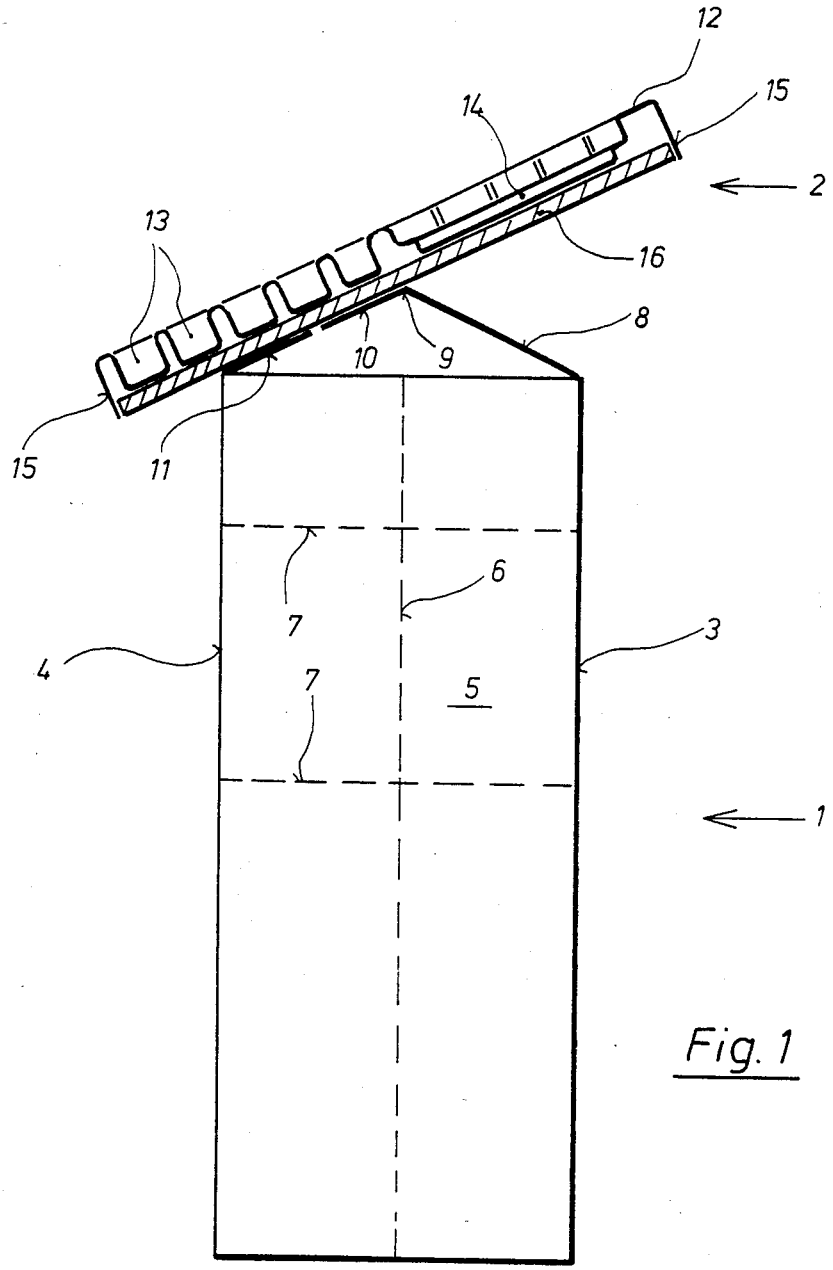
FIG. 1 shows in a side elevation a floor stand according to the invention just before completion of the erection process in a section along the line I—I of FIG. 2.

The floor stand shown consists of a leg 1 of folding material, to the upper side of which a housing device 2 for the housing and presentation of the widest variety of merchandize, which will be described in further detail below, is attached. In a manner known per se, the leg is tubular with front wall 3, a rear wall 4 and two side walls 5. Fold lines 6 are continuous and run in the longitudinal direction through the center of the side walls which also contain two transverse fold lines 7 at a mutual interval. A roof panel 8 which is articulated to the upper edge of the front wall ends via a fold line 9, oriented in the transverse direction, in a gluing panel 10. A further gluing panel 11 is articulated to the upper edge of the rear wall 4. The housing device 2 is glued by its base to the gluing panels 10, 11.

Due to the features described it is possible, solely by pivoting the housing device 2 relative to the leg, to unfold the flat-folded and extended leg into a tube shape. The leg can also, via its transverse fold lines, possibly including the transverse fold lines which connect the walls 3, 4 to the panels 8, 7, be folded in U-shape or L-shape more or less snugly round the housing device, including the merchandize present thereon, in abutment with the latter.

Figure 3:
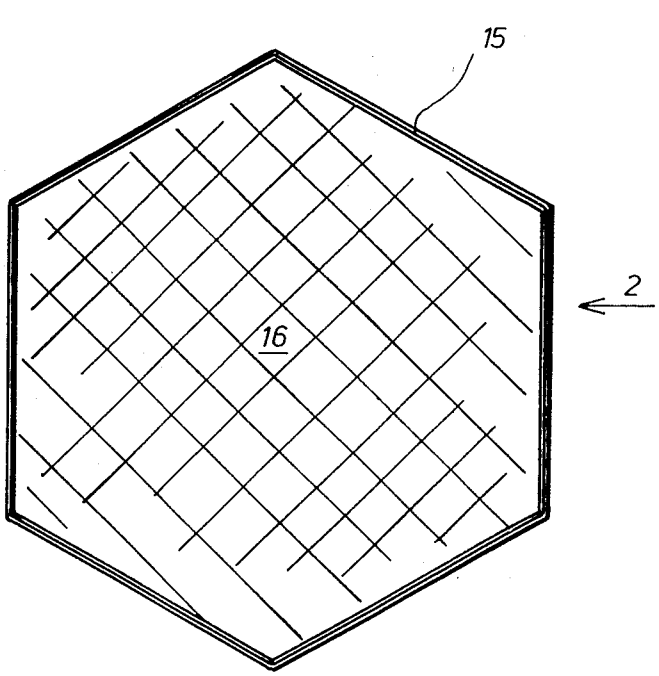
FIG. 3 shows a bottom view of the housing device.
Figure 2:
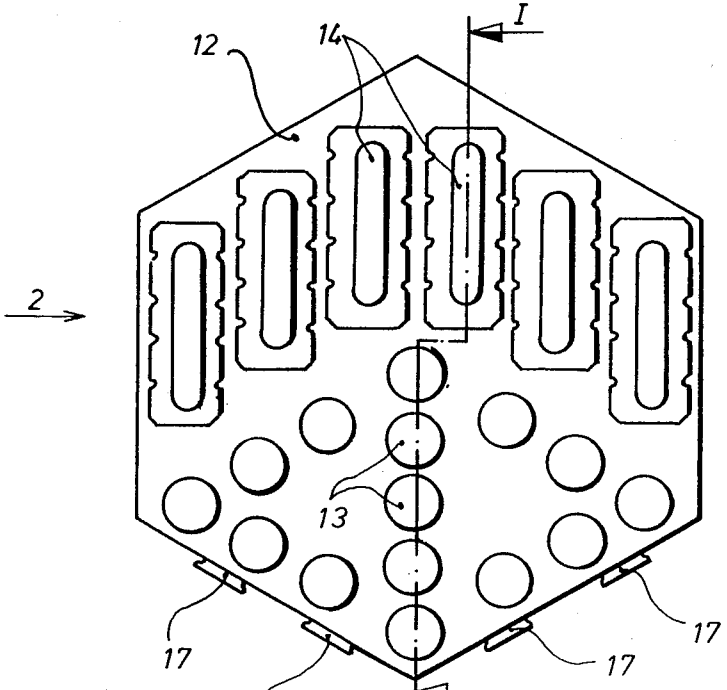
FIG. 2 shows a plan of the floor container.

According to the invention the housing device 2 consists of a deep-drawn plastic part 12 which exhibits on its upper side a plurality of depressions 13, 14 for the housing and secure positioning of merchandise. End faces 15 are moulded integrally to the tray-shaped plastic part at its rim, and are connected integrally both mutually and to the actual base of the plastic part 12. They stiffen the plastic part and mask externally a connecting plate 16 of corrugated board material inserted into the housing thereby formed. Particularly FIG. 3 shows that the shape of the connecting plate 16 corresponds to that of the plastic part 12, so that the connecting plate 16 can be inserted into the housing beneath the base plate of the plastic part.

The connection is now made by gluing the gluing straps 10, 11 of the leg to the underside of the connecting plate, and its upper side in turn to the base surfaces of the depressions 13, 14.

Hook-shaped projections 17, upon which publicity boards et cetera may be mounted, may also be integrally moulded to the rear side of the plastic part.

The example of construction described illustrates very clearly that the plastic part 12 can be shaped to correspond to the requirements of each case, including fastening possibilities for publicity areas et cetera.

What is claimed is:

1. A floor stand for presenting merchandise comprising:

a tubular leg of folding material, said leg having a front wall, a rear wall, two side walls and a roof panel;

each of said walls of said leg being joined to the adjacent wall along a longitudinal bending line and each of said walls of said leg having at least one transverse fold line;

each of said two side walls having a longitudinal fold line;

said roof panel comprising at least one piece being joined to each of said front and rear walls along a transverse bending line and having a transverse fold line which runs parallel to the planes of said front and rear walls;

a device for the housing and presentation of merchandise connected to said leg, said device having a base an end face, and a connecting plate, said base having an upper surface and a lower surface and said end face encircling said base and extending downwardly such that said lower surface of said base and said end face define a space, said connecting plate being inserted into said space to so join said roof panel to said lower surface of said base that the upper portion of said leg proximate said roof panel closely abuts said base when said leg is folded flat along said longitudinal fold lines and said longitudinal bending lines, and said connecting plate so joining said base to said roof panel that said leg is folded flat and unfolded by pivoting said housing device relative to said leg.

2. A floor stand as recited in claim 1 wherein said base defines a plurality of depressions for positioning the merchandise on said upper surface of said base, said depressions having generally flat bottoms to permit attachment of said base to said connecting plate.

3. A floor stand as recited in claim 1 wherein said end face has a lower edge and the thickness of said connecting plate is approximately equal to the height of said space from said lower edge to said lower surface of said base.

4. A floor stand as recited in claim 1 wherein said housing device is a deep drawn plastic tray and said end face and said base are integrally molded.

5. A floor stand as recited in claim 1 wherein said connecting plate is made from corrugated board material.

6. A floor stand as recited in claim 1 wherein said roof panel comprises a plurality of pieces.

7. A floor stand as recited in claim 1 wherein said connecting plate is attached to said roof panel between said transverse folding line and a transverse bending line.

8. A floor stand as recited in claim 1 wherein said longitudinal fold lines are positioned along the center of each of said two side walls.

* * * * *

UNITED STATES PATENT AND TRADEMARK OFFICE

CERTIFICATE OF CORRECTION

PATENT NO. : 4,583,705

DATED : April 22, 1986

INVENTOR(S) : Paul Schmitt

It is certified that error appears in the above—identified patent and that said Letters Patent is hereby corrected as shown below:

Col. 2, line 25, delete "upper" and substitute therefor --under--.

Signed and Sealed this

*Second* Day of *September 1986*

[SEAL]

*Attest:*

DONALD J. QUIGG

*Attesting Officer*

*Commissioner of Patents and Trademarks*